US006904721B1

(12) United States Patent
Forbes

(10) Patent No.: US 6,904,721 B1
(45) Date of Patent: Jun. 14, 2005

(54) CREMATED REMAINS HOLDER AND MARKER COMBINATION

(76) Inventor: Hampton E. Forbes, 924 McCormick Blvd., Clifton Forge, VA (US) 24422

( * ) Notice: Subject to any disclaimer, the term of this patent is extended or adjusted under 35 U.S.C. 154(b) by 15 days.

(21) Appl. No.: 10/337,174

(22) Filed: Jan. 7, 2003

(51) Int. Cl.[7] ..... E04H 13/00
(52) U.S. Cl. ..... 52/103; 52/136
(58) Field of Search ..... 52/103, 133, 136; 40/124.5

(56) References Cited

U.S. PATENT DOCUMENTS

| | | | | | |
|---|---|---|---|---|---|
| 1,940,771 | A | * | 12/1933 | Prier | 52/103 |
| 2,075,859 | A | * | 4/1937 | Martin | 52/103 |
| 2,276,749 | A | * | 3/1942 | Vanderveer | 47/41.1 |
| 2,525,091 | A | * | 10/1950 | Brownawell | 52/103 |
| 3,001,326 | A | * | 9/1961 | O'Brien et al. | 47/41.1 |
| 3,726,052 | A | * | 4/1973 | Thompson | 52/103 |
| 3,758,999 | A | | 9/1973 | Matvey | |
| 3,898,718 | A | * | 8/1975 | Eubank | 27/35 |
| 4,328,606 | A | * | 5/1982 | Nunes | 27/35 |
| 4,607,417 | A | * | 8/1986 | Hancovsky | 52/137 |
| 5,287,603 | A | * | 2/1994 | Schorman | 52/136 |
| 5,371,984 | A | | 12/1994 | Taylor | |
| 5,729,921 | A | | 3/1998 | Rojas | |
| 5,740,637 | A | * | 4/1998 | Snow | 52/136 |
| 6,088,973 | A | * | 7/2000 | Weiss | 52/105 |
| 6,167,600 | B1 | | 1/2001 | Williams et al. | |
| 6,279,212 | B1 | | 8/2001 | Balch | |
| 6,363,635 | B1 | * | 4/2002 | England | 40/124.5 |
| 6,463,703 | B1 | * | 10/2002 | Mattis | 52/103 |

* cited by examiner

*Primary Examiner*—Anita M. King

(57) ABSTRACT

A cremated remains holder and marker combination device includes a panel having a top side and a bottom side. The panel has at least one opening extending through the top and bottom sides. Indicia are selectively engraved in the top side for identifying cremated remains. At least one receptacle includes a bottom wall and a peripheral wall attached to and extending upwardly from the bottom wall. The peripheral wall has an upper edge attached to and extending along a length of a perimeter edge of the at least one opening. The receptacle is adjacent to the bottom side of the panel and defines a receiving device for receiving cremated remains. A plate is positionable over the at least one opening and is removably attached to the panel for selectively closing the at least one opening.

5 Claims, 6 Drawing Sheets

CREMATED REMAINS HOLDER AND MARKER COMBINATION

BACKGROUND OF THE INVENTION

1. Field of the Invention

The present invention relates to grave markers and more particularly pertains to a new grave marker for providing an economical alternative to conventional cremation markers, which could be employed for multiple burials. This invention is designed to provide a more affordable means of burying ashes of departed loved ones to eliminate the need for multiple burial posts.

2. Description of the Prior Art

The use of grave markers is known in the prior art. U.S. Pat. No. 5,371,984 describes a tombstone with cells for interring urns. Another type of grave marker is U.S. Pat. No. 6,167,600 having a columbarium system for the storage of human remains that includes a plurality of similarly configured storage containers. U.S. Pat. No. 5,729,921 describes a burial marker and display box for the preservation of memorabilia and or ashes of an individual. U.S. Pat. No. 3,758,999 describes a grave marker protective structure. U.S. Pat. No. 6,279,212 describes a cremation and record burial system for burial of a deceased's remains and personal artifacts.

While these devices fulfill their respective, particular objectives and requirements, the need remains for a device that is designed to contain ashes of several family members and can support multiple identification plates which are changeable.

SUMMARY OF THE INVENTION

The present invention meets the needs presented above by having multiple receptacles for holding a plurality of urns.

Another object of the present invention is to provide a new grave marker that would help reduce the financial burden placed on surviving family members.

Still another object of the present invention is to provide a new grave marker that would save space by having multiple marker plates and multiple receptacles such that multiple members of the same family may be buried in one spot.

To this end, the present invention generally comprises a panel having a top side and a bottom side. The panel has at least one opening extending through the top and bottom sides. Indicia are selectively engraved in the top side for identifying cremated remains. At least one receptacle includes a bottom wall and a peripheral wall attached to and extending upwardly from the bottom wall. The peripheral wall has an upper edge attached to and extending along a length of a perimeter edge of the at least one opening. The receptacle is adjacent to the bottom side of the panel and defines a receiving device for receiving cremated remains. A plate is positionable over the at least one opening and is removably attached to the panel for selectively closing the at least one opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
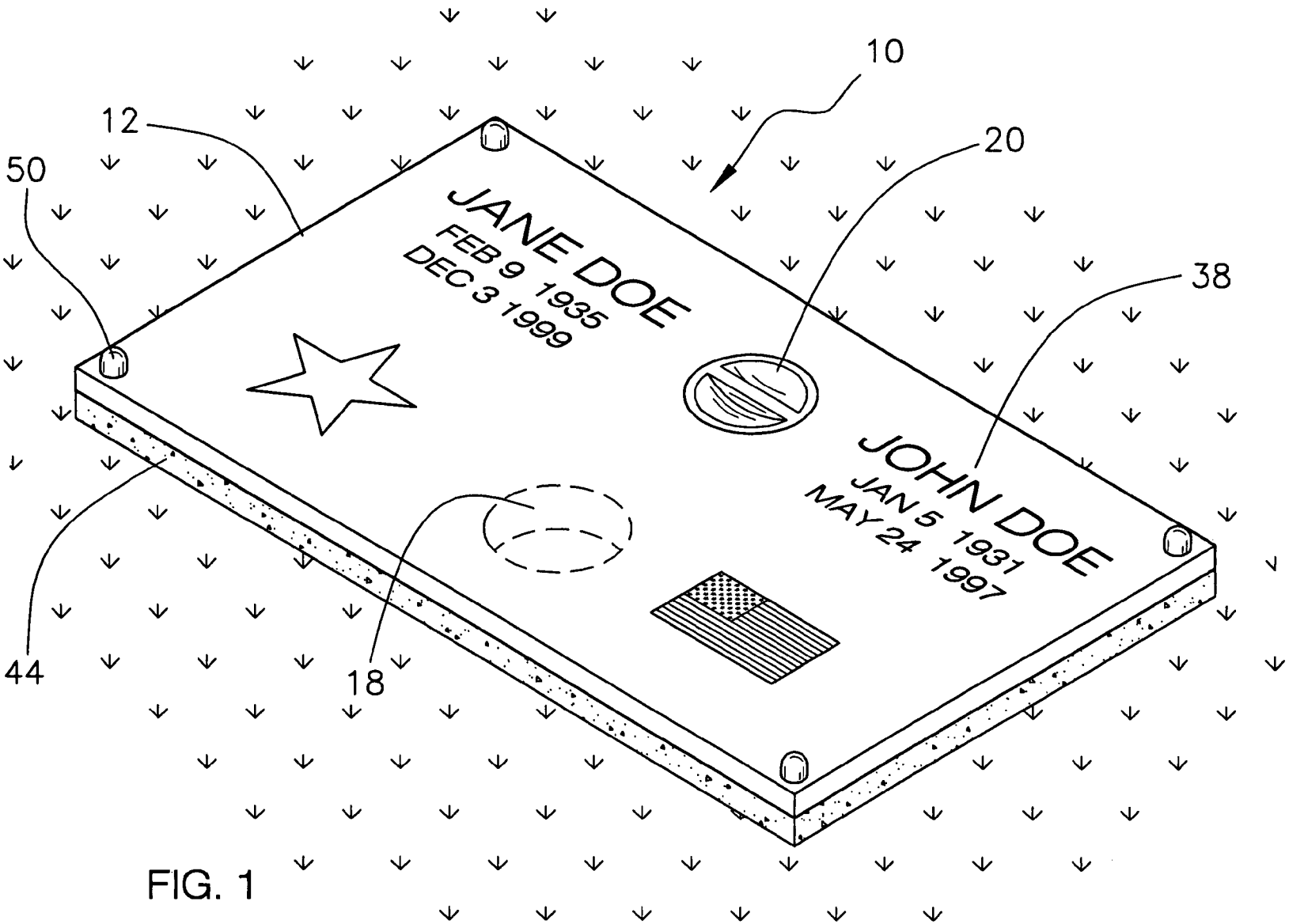
FIG. 1 is a perspective view of a first embodiment of a cremated remains and marker combination according to the present invention.

With reference now to the drawings, and in particular to FIGS. 1 through 6 thereof, a new grave marker embodying the principles and concepts of the present invention and generally designated by the reference numeral 10 will be described.

As best illustrated in FIGS. 1 through 6, the cremated remains and marker combination device 10 includes a panel 12 having a top side 14 and a bottom side 16. The panel 12 has a plurality of openings 18 extending through the top 14 and bottom 16 side. The panel 12 comprises a substantially rigid material which preferably comprises a metallic material. At least one of the openings 18 is resealable and defines a resealable opening 19. A cap 20 for selectively opening or closing the resealable opening 19 preferably has a threaded perimeter edge 22 for threadably engaging threads 24 on a peripheral edge 26 of the resealable opening 19. A container 28 has an open end 30 that is attached to the cap 20. The container 28 has a size and shape for selectively positioning in through the resealable opening 18.

Each of a plurality of plates 32 has a first side 34 and a second side 36. Each of the plates 32 has a size and shape adapted for removably fitting over one of the openings 18 such that the second side 36 is abutting the top side 14 of the panel 12. Indicia 38 are positionable on the first side 34 of the plate 32 for indication purposes. A plurality of securing members 40 selectively secures the plates 32 to the panel 12. Each of the securing members 40 preferably comprises a bolt. The bolts are extendable through a selected one of the plates 32 and into the top side 14 of the panel 12.

A base 44 has an upper surface 46. A plurality of coupling members 48 is attached to the base 44 for selectively attaching the upper surface 46 of the base 44 to the bottom side 16 of the panel 12. The coupling members 48 are preferably bolts that are extending through the panel 12 and secured with nuts 50 having a convex outer surface. The upper surface 46 of the base 44 has a plurality of wells 52 extending therein. Each of the wells 52 is aligned with one of the openings 18 in the panel 12. The base 44 preferably comprises a concrete block, though other man made or natural materials (e.g. granite, stone) may be used.

A receptacle 54 is positioned in one of the wells 52 not positioned adjacent to the resealable opening 19. The receptacle 54 has an open upper edge 56 that is flush with an upper surface 46 of the base 44. The receptacle 54 extends downward through a bottom of the base 44.

Figure 5:
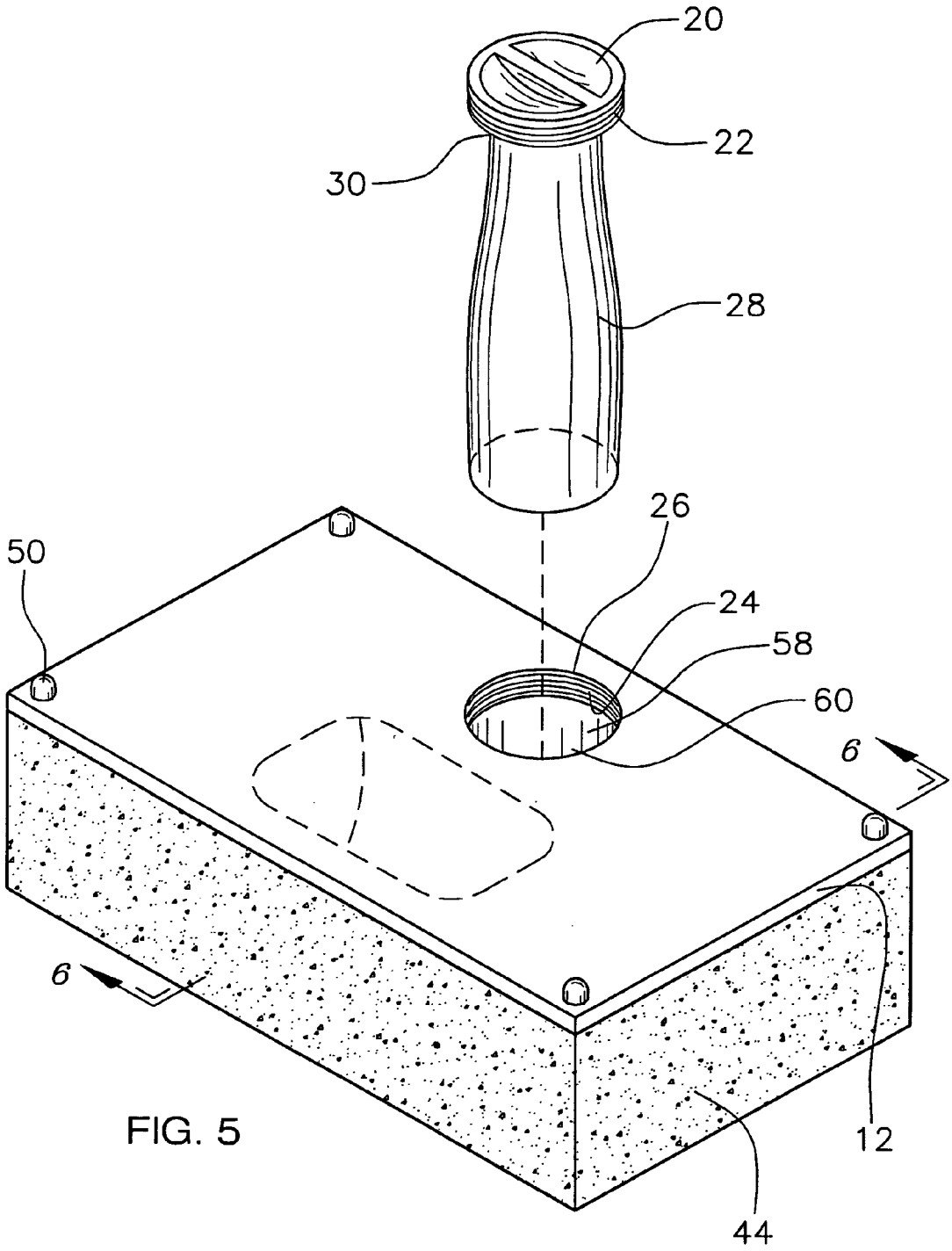
FIG. 5 is a perspective view of the first embodiment of present invention.
Figure 6:
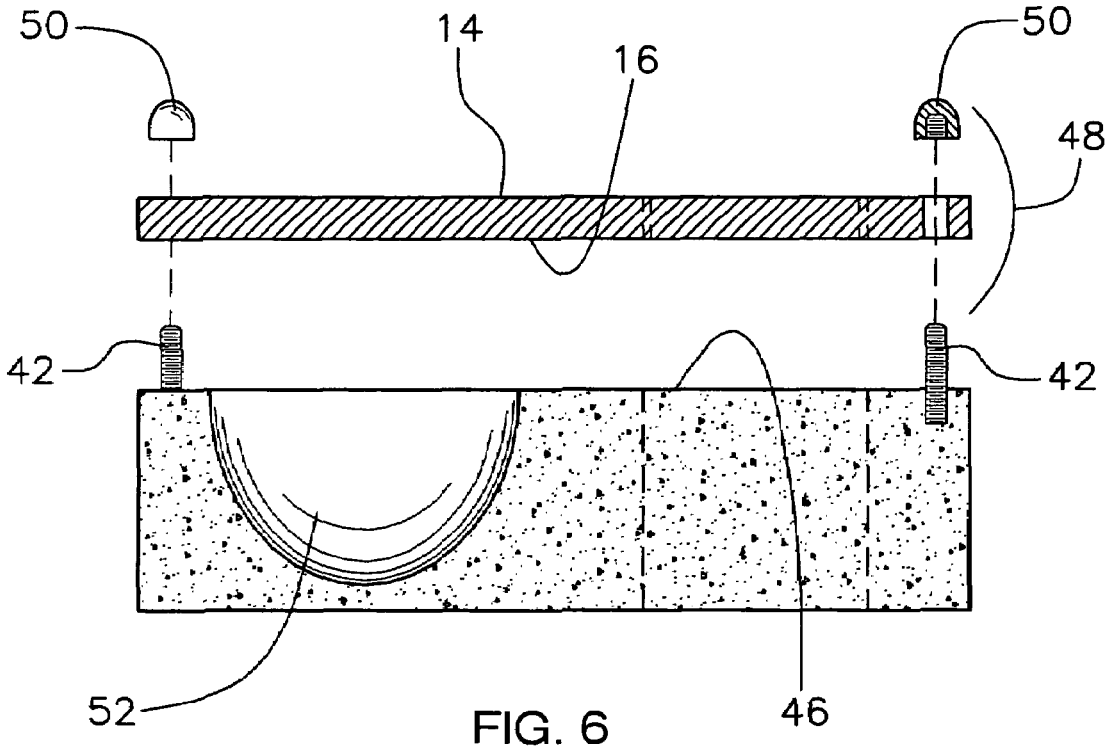
FIG. 6 is a cross-sectional view taken along line 6—6 of FIG. 5 of the present invention.

The device may have a plurality of embodiments, three of which are depicted in the Figures. FIGS. 1, 5 and 6 depict a first embodiment that includes a base 44 and a panel 12 with only one opening 18 therein which is a resealable opening 19. The base 44 has two wells 52, one that holds cremated remains, and a second opening 58, which is aligned with the resealable opening. The container 28 is extendable into the second well 60 when not in use and the cap 20 inserted into the resealable opening 19. To use the container, the cap 20 is turned upside down and inserted into the resealable opening 19 so that the container 28 extends upwardly and flowers may be inserted therein. The panel 12 covers the well 52 when it is attached to the base 44.

Figure 2:
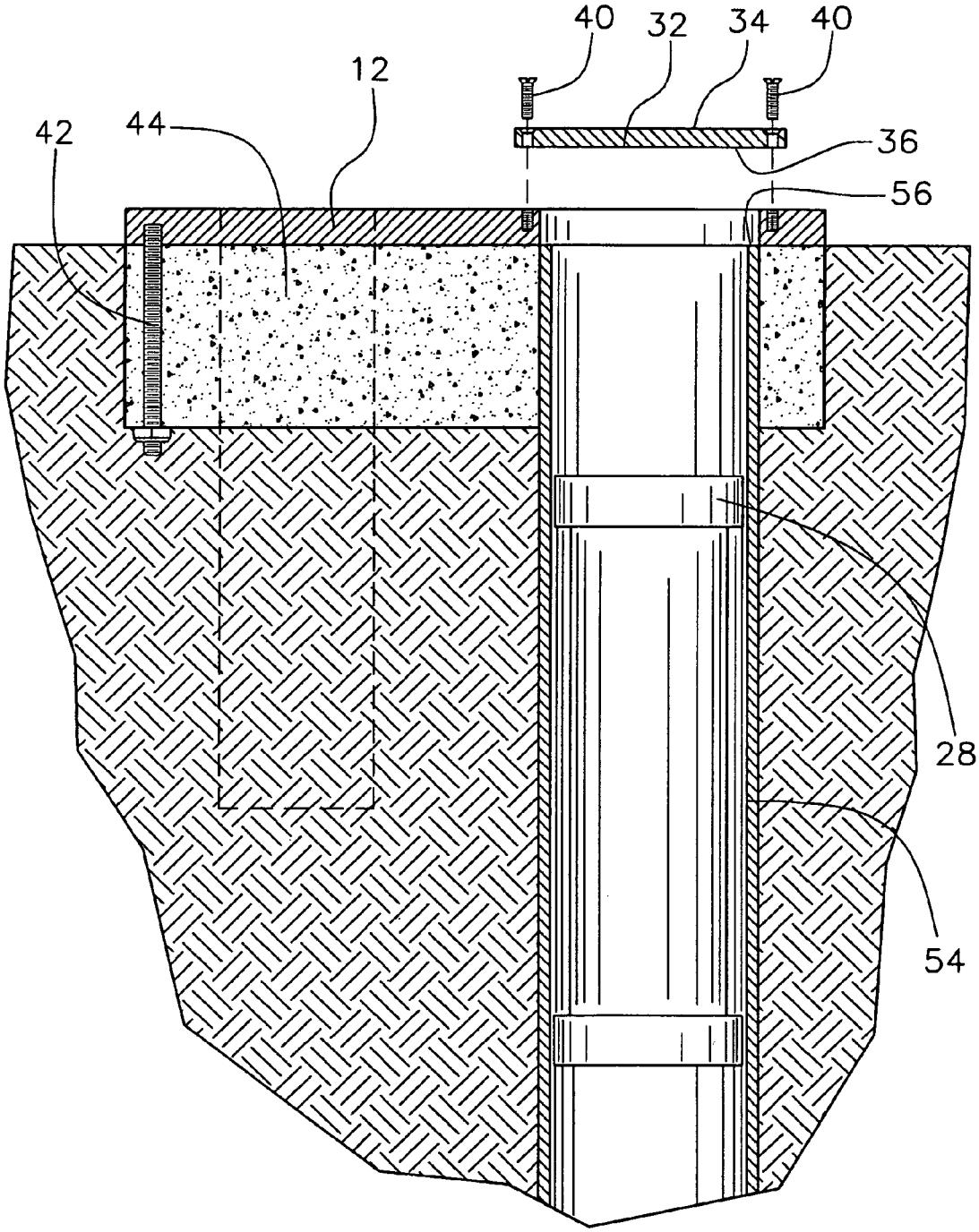
FIG. 2 is a cross-sectional view taken along line 2—2 of FIG. 3 of the present invention.
Figure 3:
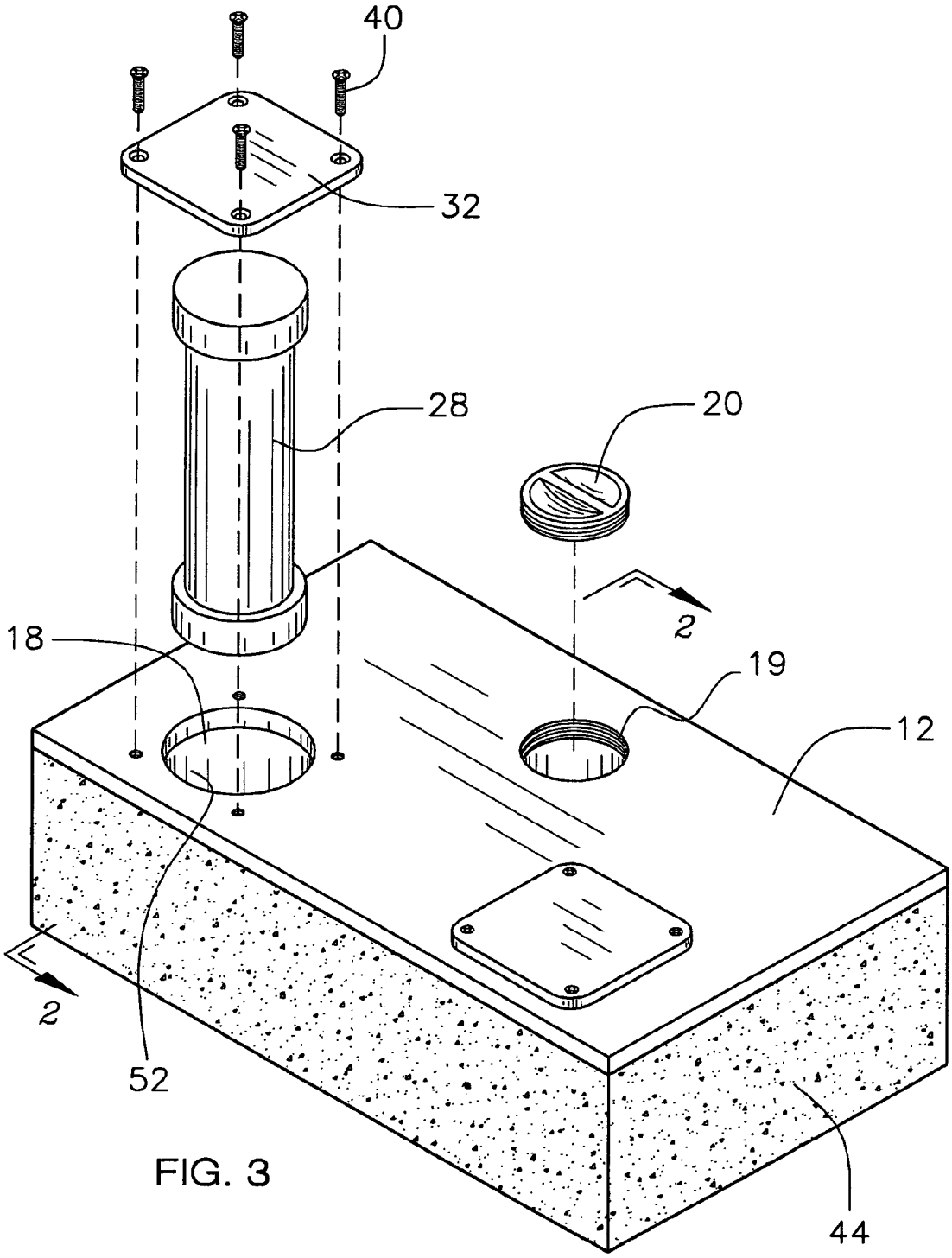
FIG. 3 is a perspective view of a second embodiment of the present invention.

The second embodiment, shown in FIGS. 2 and 3, includes additional openings 18 in the panel 12, which are each alignable with one of the wells 52. To cover the wells 52, plates 32 are attachable to the panel 12. The plates 32 may or may not have indicia 38 thereon. Additionally, the receptacle 54 is positioned in one of the wells 52 and extends through the base 44. The receptacle 54 is adapted for holding a plurality of containers 28 each holding the cremated remains of a different person. This allows the remains of multiple family members to be positioned in the same well 52.

Figure 4:
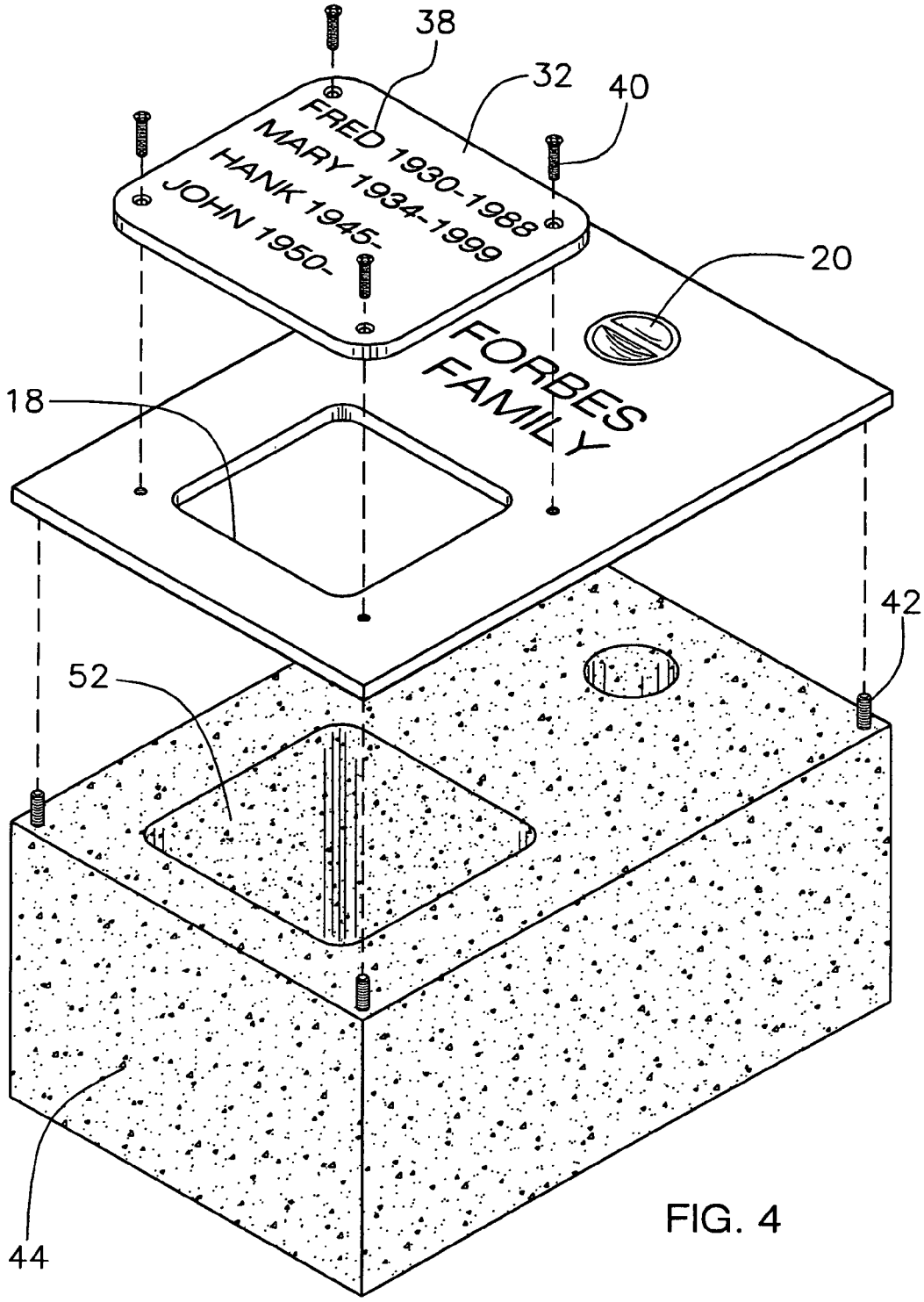
FIG. 4 is a perspective view of a third embodiment the present invention.

The third embodiment, depicted in FIG. 4, includes the multiple openings 18 and plates 32 of the second embodiment, but does not have the receptacle 54. This embodiment, as the second embodiment, may include more than one well 52, each adapted for holding cremated remains.

The panel 12 itself may have indicia 38 thereon for indicating the person or persons whose remains are positioned there below.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cremated remains holder and designator combination device, said device comprising:

a panel having a top side and a bottom side, said panel having a plurality of openings extending through said top and bottom sides, said panel comprising a substantially rigid material;

a plurality of plates, each of said plates having a first side and a second side, each of said plates having a size and shape adapted for removably fitting over one of said openings;

a plurality of securing members for selectively securing said plates to said panel;

a base having an upper surface, a plurality of coupling members being attached to said base for selectively attaching said upper surface of said base to said bottom side of said panel, said upper surface of said base having a plurality of wells extending therein, each of said wells being aligned with one of said openings in said panel when said base is attached to said panel;

a receptacle being positioned in one of said wells, said receptacle having an open upper edge being flush with said upper surface of said base; said receptacle extending downward through a bottom of said base; and wherein said base is positioned in a hole in a ground surface such that said panel is generally flush with the ground surface, wherein indicia may be engraved in said top side for identifying cremated remains positioned beneath said panel.

2. The cremated remains holder and designator combination device of claim 1, wherein at least one of said openings is resealable and defines a resealable opening, a cap being positionable into said resealable open for selectively opening or closing said resealable opening.

3. The cremated remains holder and designator combination device of claim 2, further including a container having an open end being attached to said cap, said container having a size and shape for selectively positioning in through said resealable opening.

4. The cremated remains holder and designator combination device of claim 2, wherein said cap has a threaded perimeter edge for threadably engaging threads on a peripheral edge of said resealable opening.

5. A cremated remains holder and designator combination device, said device comprising:

a panel having a top side and a bottom side, said panel having a plurality of openings extending through said top and bottom sides, said panel comprising a substantially rigid material, said rigid material comprising a metallic material, at least one of said openings being resealable and defining a resealable opening, a cap for selectively opening or closing said resealable opening, said cap having a threaded perimeter edge for threadably engaging threads on a peripheral edge of said resealable opening, a container having an open end being attached to said cap, said container having a size and shape for selectively positioning in through said resealable opening;

a plurality of plates, each of said plates having a first side and a second side, each of said plates having a size and shape adapted for removably fitting over one of said openings such that said second side is abutting said top side of said panel, indicia being positioned on said first side of said plate;

a plurality of securing members for selectively securing said plates to said panel, each of said securing members comprising a bolt, each of said bolts being extendable through a selected one of said plates and into said top side of said panel;

a base having an upper surface, a plurality of coupling members being attached to said base for selectively attaching said upper surface of said base to said bottom side of said panel, said upper surface of said base having a plurality of wells extending therein, each of said wells being aligned with one of said openings in said panel, said base comprising a concrete block;

a receptacle being positioned in one of said wells not positioned adjacent to said resealable opening, said receptacle having an open upper edge being flush with said upper surface of said base, said receptacle extending downward through a bottom of said base; and wherein said base is positioned in a hole in a ground surface such that said panel is generally flush with the ground surface, wherein indicia may also be engraved in said top side for identifying cremated remains positioned beneath said panel.

* * * * *